US008457320B2

(12) United States Patent
Konchitsky et al.

(10) Patent No.: US 8,457,320 B2
(45) Date of Patent: Jun. 4, 2013

(54) WIND NOISE CLASSIFIER

(76) Inventors: Alon Konchitsky, Santa Clara, CA (US); Alberto D Berstein, Cupertino, CA (US); Sandeep Kulakcherla, Santa Clara, CA (US); William Martin Ribble, San Jose, CA (US); Kevin Fitzgerald, Pleasanton, CA (US); Don Seferovich, Nevada City, CA (US)

( * ) Notice: Subject to any disclaimer, the term of this patent is extended or adjusted under 35 U.S.C. 154(b) by 510 days.

(21) Appl. No.: 12/833,804

(22) Filed: Jul. 9, 2010

(65) Prior Publication Data

US 2011/0007906 A1 Jan. 13, 2011

Related U.S. Application Data

(60) Provisional application No. 61/224,605, filed on Jul. 10, 2009.

(51) Int. Cl.
*H04R 29/00* (2006.01)

(52) U.S. Cl.
USPC ..... 381/56; 381/122; 381/94.1; 381/94.2; 704/226; 704/233

(58) Field of Classification Search
USPC ..... 381/56–57, 92, 94.1–94.3, 94.7, 381/94.8, 122; 704/226, 233
See application file for complete search history.

(56) References Cited

U.S. PATENT DOCUMENTS

| | | | | |
|---|---|---|---|---|
| 2002/0037088 | A1 | 3/2002 | Dickel et al. | |
| 2009/0238369 | A1 * | 9/2009 | Ramakrishnan et al. | 381/56 |
| 2010/0061568 | A1 * | 3/2010 | Rasmussen | 381/94.1 |
| 2010/0082339 | A1 * | 4/2010 | Konchitsky et al. | 704/226 |
| 2010/0246834 | A1 * | 9/2010 | Lee | 381/56 |

FOREIGN PATENT DOCUMENTS

| | | | |
|---|---|---|---|
| EP | 1339256 | A2 | 3/2004 |
| EP | 1732352 | A1 | 12/2006 |

OTHER PUBLICATIONS

Stephen C. Thompson, "Tutorial on microphone technologies for directional hearing aids", The Hearing Journal, Nov. 2003, vol. 56, No. 11.

* cited by examiner

*Primary Examiner* — Disler Paul
(74) *Attorney, Agent, or Firm* — Steven A. Nielsen; Allman & Nielsen, P.C.

(57) ABSTRACT

A special purpose machine measures and modulates communication signals that are parsed into frames. Frames of signals modulated and measured to have certain qualities are deemed to be the result of wind noise. Frames of wind noise are cancelled from further use within a communication system.

2 Claims, 16 Drawing Sheets

General block diagram of a Microprocessor system

Bluetooth Headset

Cell phone

Cordless Phone (1 frame = 160 samples = 20 milli seconds at 8000 Hz sampling frequency)

WIND NOISE CLASSIFIER

CROSS-REFERENCE TO RELATED APPLICATIONS

This application claims the benefit and priority date of co-pending application 61/224,605 filed on Jul. 10, 2010 and entitled "Wind Noise Classifying Machine (WNCM)", the contents of which are incorporated herein by reference.

REFERENCES CITED

| | | |
|---|---|---|
| US 2002/0030788 | EP February 2002 | Dickel et al |
| EP 1 339 256 A2 | March 2004 | Roeck et al |
| EP 1 732 352 A1 | December 2006 | Hetherington et al |

OTHER REFERENCES

[1] Stephen C. Thompson, "Tutorial on microphone technologies for directional hearing aids", The Hearing Journal, November 2003, Vol. 56, No. 11

FIELD OF THE INVENTION

The present invention relates to means and methods of manipulating electrical signals in a manner useful in classifying wind noise from other stationary noises in voice communication systems, devices, telephones, and other communication systems.

This invention is in the field of processing signals in cell phones, Bluetooth headsets, Car kits, VoIP gateways, Conference bridges etc. In general, embodiments of the disclosed invention relate to and are useful in any device which operates in different noisy environments and needs to classify wind and other stationary noise environments so that a particular noise reduction method and/or specialized machine can be used for a particular noisy environment.

Communication devices are used in different environments and are subjected to different environmental noises such as restaurant noise, street noise, train noise, car noise, airport noise and wind noise. Of all these types of noise, wind noise is highly non-stationary. Its power and spectral characteristics vary greatly. The power characteristics of restaurant, street, car noises' etc are stationary and do not vary greatly and are generally classified as stationary noise types. For applications like professional recordings, news broadcast etc., it is possible to mitigate the effects of wind noise using high quality microphones coupled with wind screens (Metal or foam based). However, these solutions cannot be directly applied to mobile devices (cell phones, Bluetooth headsets etc) as they add to the Bill of Materials (BoM) of the device.

Cell phones, Bluetooth headsets are used in windy and non-windy conditions. VoIP (Voice over Internet Protocol) gateways, Conference bridges receive signals from quiet, noisy, windy and non-windy environments. Because of its high non-stationary, regular noise reduction algorithms cannot be used to reduce wind noise. Hence the communication devices require two different noise reduction algorithms and a means to select a particular algorithm for a particular type of noise. Hence classifying wind noise from other stationary noises is important.

BACKGROUND OF THE INVENTION

Voice communication devices such as cell phones, wireless phones and devices other than cell phones have become ubiquitous; they show up in almost every environment. These systems and devices and their associated communication methods are referred to by a variety of names, such as but not limited to, cellular telephones, cell phones, mobile phones, wireless telephones in the home and the office, and devices such as Personal Data Assistants (PDA$^s$) that include a wireless or cellular telephone communication capability. They are used at home, office, inside a car, a train, at the airport, beach, restaurants and bars, on the street, and almost any other venue. As might be expected, these diverse environments have relatively higher and lower levels of background, ambient, or environmental noise.

The term "wind noise" is used to describe several different ways that wind can be generated. For example, wind can cause a loose shutter to bang against a house or it can cause a flag to rustle and snap. In these cases, the wind has caused an object to move, and the motion makes a sound. In other cases, wind moving past an object can create a howling sound, even though the object does not vibrate. Here, the sound is caused by turbulence that is created in the moving air as it passes by the object. This turbulence, which cannot be seen, is very similar to the turbulence in a fast-moving stream as the water flows around and over large rocks. We have all experienced this kind of wind noise while inside a house during a windstorm. The sound of the howling wind originates in the turbulence of air motion past the walls and roof.

The form of wind noise that most interferes with our ability to hear and communicate is the noise generated by air flow around our own head. Here the sound is generated within centimeters of our ears, and may be heard at quite a high level because of this close proximity [1]

Wind noise has been studied extensively and many solutions have been proposed for hearing aids, Bluetooth headsets, car kits, cell phones etc.

Wind noise exhibits some properties and features that are not common to other types of noise encountered in our daily lives. Depending on the wind speed, direction, physical obstructions like hats, caps, hand etc the characteristics of wind noise vary greatly. For these reasons, it is difficult to detect and classify the presence of wind noise from other environmental noises.

It is known art to reduce wind noise by mechanical means such as foam, scrims etc. To be sufficiently effective, the mechanical means must be thick which might make the device look bulky. Also these solutions add up to the Bill of Materials (BoM) of the device. This can be undesirable.

However, certain factors make wind noise unique. Wind noise predominantly is a low-frequency phenomenon. Many of the known art technologies detect wind noise using the property of low correlation of the wind noise between multiple microphones separated spatially.

Several attempts to detect wind noise are known in the related art. US patent US2002/037088, assigned to Dickel et al, detects wind noise by computing the correlation between signals received at the two microphones. Turbulence created at the two microphones, without any obstructions, causes signals with low correlation. However, our studies showed that obstructions in the vicinity of the microphone result the correlation to be high.

European patent EP 1 339 256 A2, assigned to Roeck et al, uses several of the well know wind noise properties like high energy content at low frequencies, low auto-correlation at two microphones and high signal amplitudes. However, this approach also suffers from the same drawbacks discussed above.

European patent application EP 1 732 352 A1, assigned to Hetherington et al, uses multiple microphones where power levels in different microphones are compared. When the power level of the sound received at the second microphone is less than the power level of the sound received at the first microphone by a predefined value, wind noise may be present. However, this approach requires one of the microphones to be directional with high directivity index and the other microphone to be Omni-directional with low directivity index.

Hence there is a need in the art for a method of wind noise detection and classification that is robust, suitable for mobile use, and inexpensive to manufacture.

It is an objective of the present invention to provide methods and devices that overcome disadvantages of prior art wind noise detection and classification schemes.

SUMMARY OF THE INVENTION

The present invention provides a novel system and method for manipulating, reconfiguring, and analyzing signals in a manner useful for detecting and classifying wind noise in devices, including but not limited to, cell phones, Bluetooth headsets, car kits, cordless phones, VoIP gateways, conference bridges etc. Embodiments of the invention facilitate this classification and thus assist in applying a particular noise reduction for a particular type of noise.

In one aspect of the invention, the invention provides a method that enhances the convenience of using a cellular telephone or other wireless telephone or communications device, even in a location having relatively loud wind or ambient noise so that the noise is cancelled before being transmitted to another party.

In yet another aspect of the invention, the invention continuously, via a microphone, monitors and modulates wind noise, and provides on the fly analysis and classification determining if the noise input is wind noise or other stationary noise.

In another aspect of the invention, wind noise is judged as being present or absent in conference bridges, VoIP gateways where various communication signals are received from various parties calling in.

In yet another aspect of the invention, the invention continuously monitors if the noise is wind noise or other stationary noise in conference bridges, VoIP gateways.

In still another aspect of the invention, an enable/disable switch is provided on a cellular telephone device to enable/disable the disclosed wind noise classifier system.

These and other aspects of the present invention will become apparent upon reading the following detailed description in conjunction with the associated drawings. The present invention overcomes shortfalls in the related art; economies in hardware and power consumption. These modifications, other aspects and advantages will be made apparent when considering the following detailed descriptions taken in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

The present invention provides a novel and unique technique for detecting and classifying wind noise from other stationary noises for a communication device such as a cellular telephone, wireless telephone, cordless telephone, recording device, a handset, and other communications and/or recording devices. While the present invention has applicability to at least these types of communications devices, the principles of the present invention are particularly applicable to all types of communication devices, as well as other devices that process or record speech in noisy environments such as voice recorders, dictation systems, voice command and control systems, and the like. For simplicity, the following description employs the term "telephone" or "cellular telephone" as an umbrella term to describe the embodiments of the present invention, but those skilled in the art will appreciate the fact that the use of such "term" is not considered limiting to the scope of the invention, which is set forth by the claims appearing at the end of this description.

Hereinafter, preferred embodiments of the invention will be described in detail in reference to the accompanying drawings. It should be understood that like reference numbers are used to indicate like elements even in different drawings. Detailed descriptions of known functions and configurations that may unnecessarily obscure the aspect of the invention have been omitted.

Figure 1A:
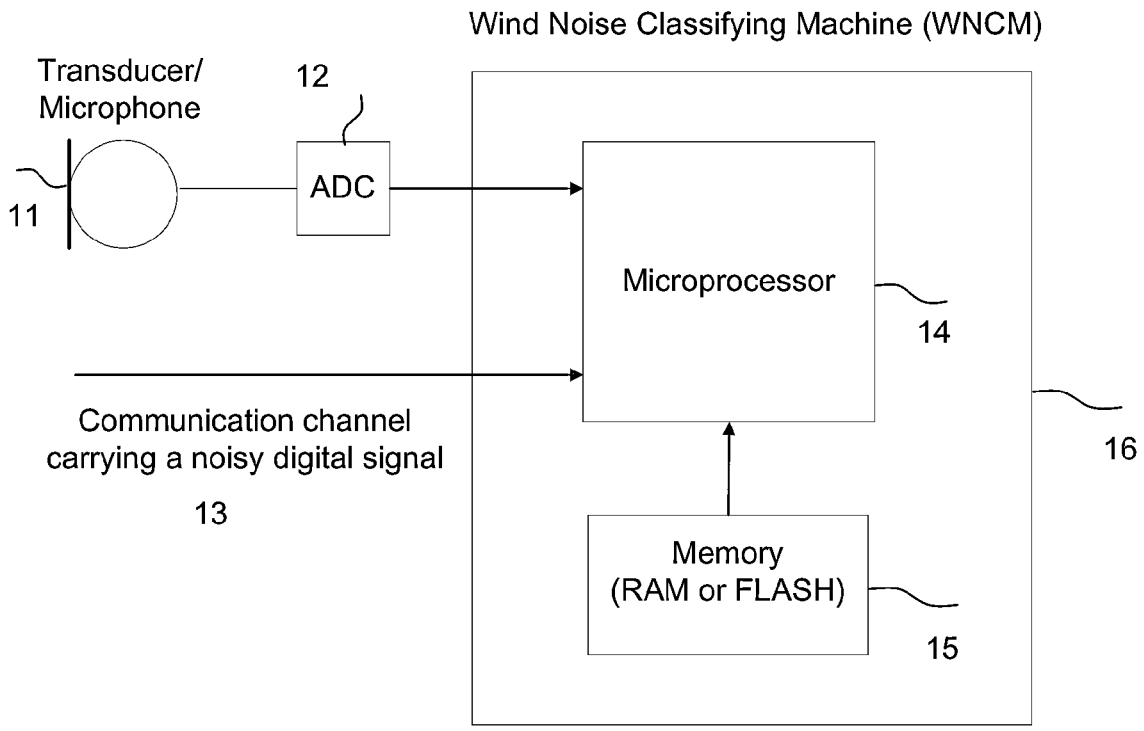
FIG. 1*a* shows the embodiments of the Wind Noise Classifying Machine (WNCM) as described in the current invention.

FIG. 1*a* shows the embodiments of the Wind Noise Classifying Machine (WNCM) as described in the current invention. The transducer/microphone, 11, of the communication device, picks up the analog signal. The Analog to Digital Converter (ADC), block 12, converts the analog signal to digital signal. The digital signal is then sent to the Wind Noise Classifying Machine (WNCM), block 16. In general any communication signal received from a communication device, block 13, in its digital form, is sent to the WNCM. The WNCM (block 16) comprises a microprocessor, block 14 and a memory, block 15. The microprocessor can be a general purpose Digital Signal Processor (DSP), fixed point or floating point, or a specialized DSP (fixed point or floating point).

Examples of DSP include Texas Instruments (TI) TMS320VC5510, TMS320VC6713, TMS320VC6416 or Analog Devices (ADI) BF531, BF532, 533 etc or Cambridge Silicon Radio (CSR) BlueCore 5 Multi-media (BC5-MM) or BC7-MM. In general, the WNCM can be implemented on any general purpose fixed point/floating point DSP or a specialized fixed point/floating point DSP.

The memory can be Random Access Memory (RAM) based or FLASH based and can be internal (on-chip) or external memory (off-chip). The instructions reside in the internal or external memory. The microprocessor, in this case a DSP, fetches instructions from the memory and executes them.

Figure 1B:
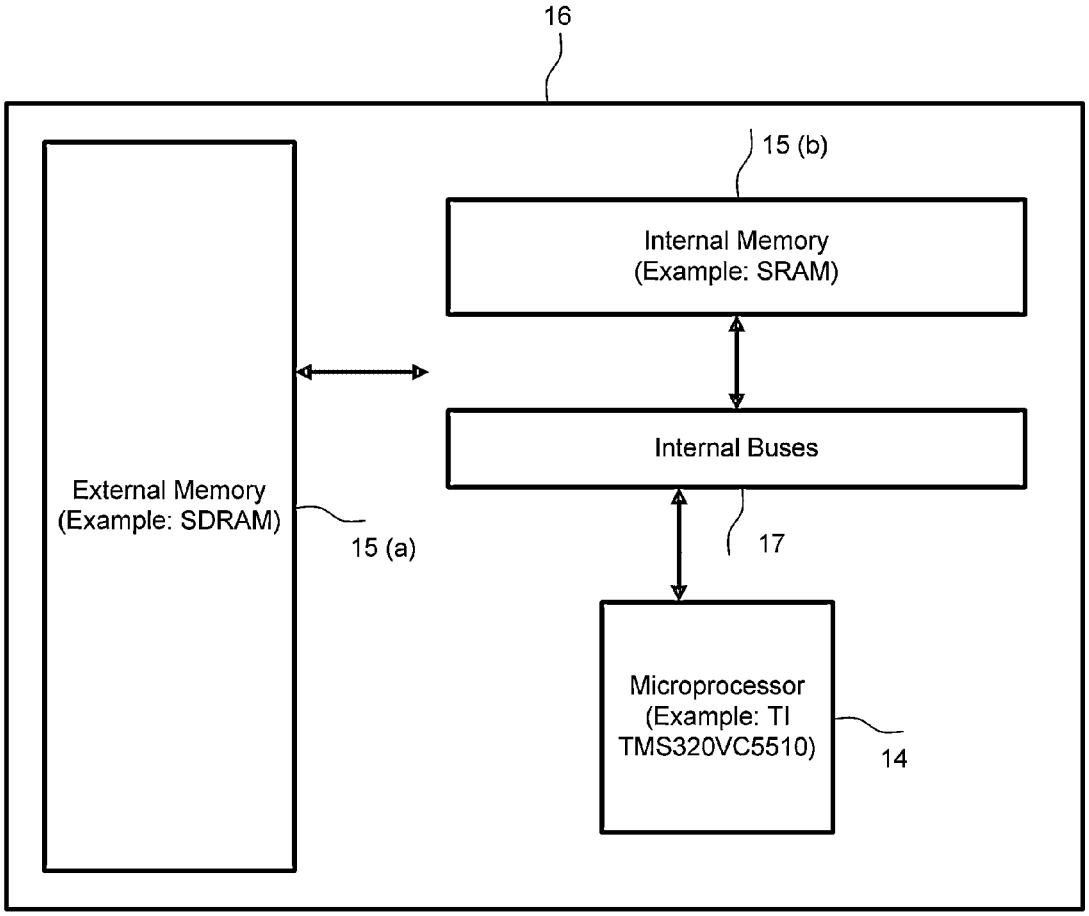
FIG. 1*b* shows the general block diagram of a microprocessor system consistent with the principles of the disclosed invention.

FIG. 1*b* shows the embodiments of block 16. It is a general block diagram of a DSP system where WNCM is implemented. The internal memory, block 15 (*b*) for example, can be SRAM (Static Random Access Memory) and the external memory, block 15 (*a*) for example, can be SDRAM (Synchronous Dynamic Random Access Memory). The microprocessor, block 14 for example, can be TI TMS320VC5510. However, those skilled in the art, can appreciate the fact that the block 14, can be a microprocessor, a general purpose fixed/floating point DSP or a specialized fixed/floating point DSP.

The internal buses, block 17, are physical connections that are used to transfer data. All the instructions to classify wind noise and stationary noise reside in the memory and are executed in the microprocessor.

Figure 2:
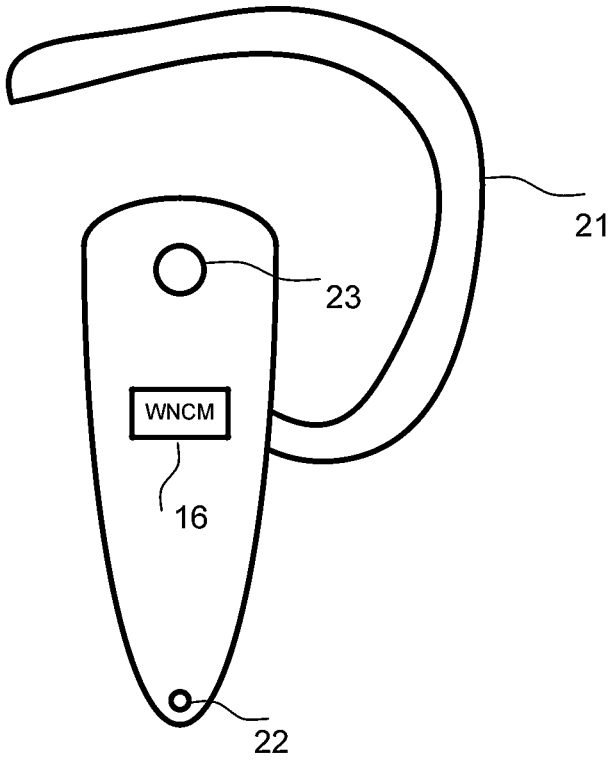
FIG. 2 shows the application of WNCM in a Bluetooth headset.

FIG. 2 shows a Bluetooth headset with WNCM. In FIG. 2, 22 is the microphone of the device. 23 is the speaker of the device. 21 is the ear hook of the device. Block 16 is the WNCM which decides if the communication signal is windy or not.

Figure 3:
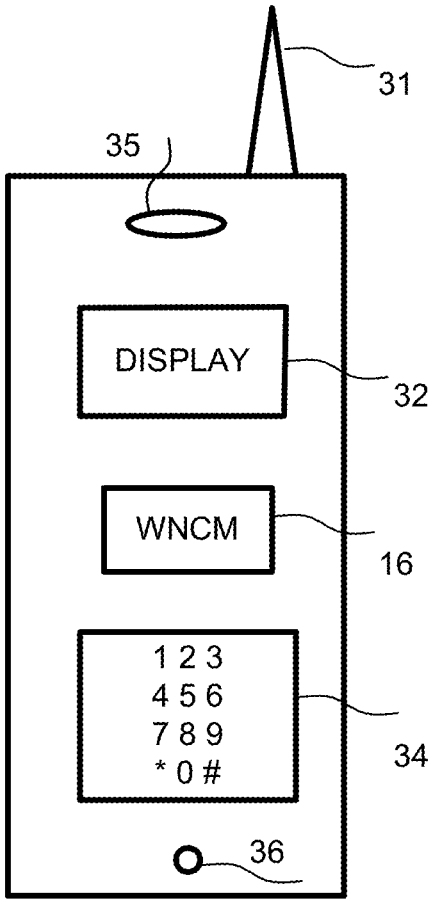
FIG. 3 shows the application of WNCM in a cell phone.

FIG. 3 shows a cell phone with WNCM. In FIG. 3, 31 is the antenna of the cell phone, 35 is the loudspeaker. 36 is the microphone. 32 is the display, 34 is the keypad of the cell phone. Block 16 is the WNCM which decides if the communication signal is windy or not.

Figure 4:
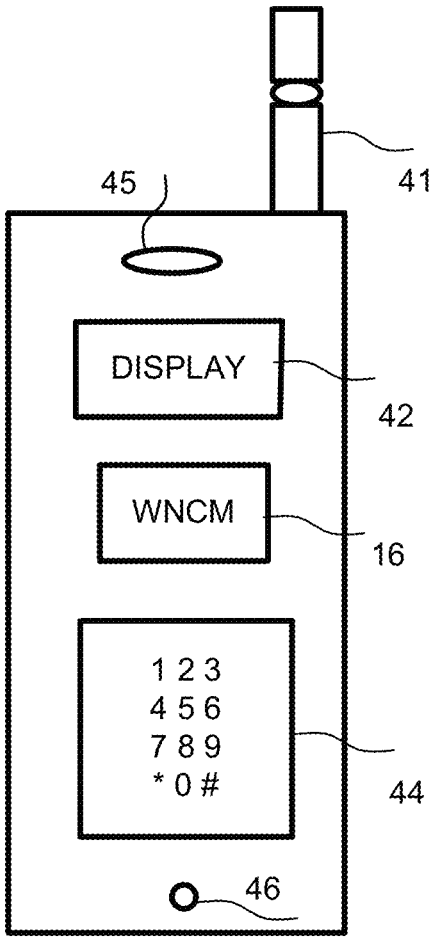
FIG. 4 shows the application of WNCM in a cordless phone.

FIG. 4 shows a cordless phone with WNCM. In FIG. 4, 41 is the antenna of the cell phone, 45 is the loudspeaker. 46 is the microphone. 42 is the display, 44 is the keypad of the cell phone. Block 16 is the WNCM which decides if the communication signal is windy or not.

Figure 5:
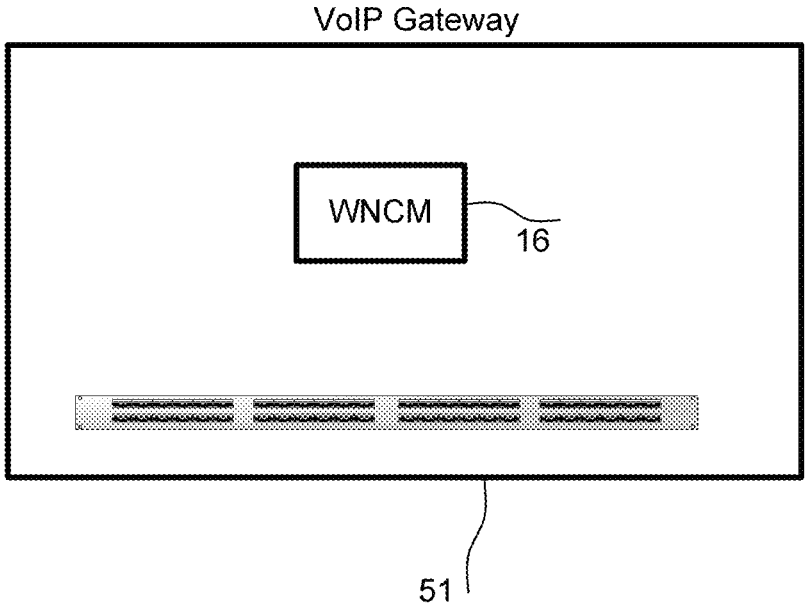
FIG. 5 shows the application of WNCM in a VoIP gateway.

FIG. 5 shows a VoIP gateway, 51 with WNCM. Block 16 is the WNCM which decides if the communication signal is windy or not.

Figure 6:
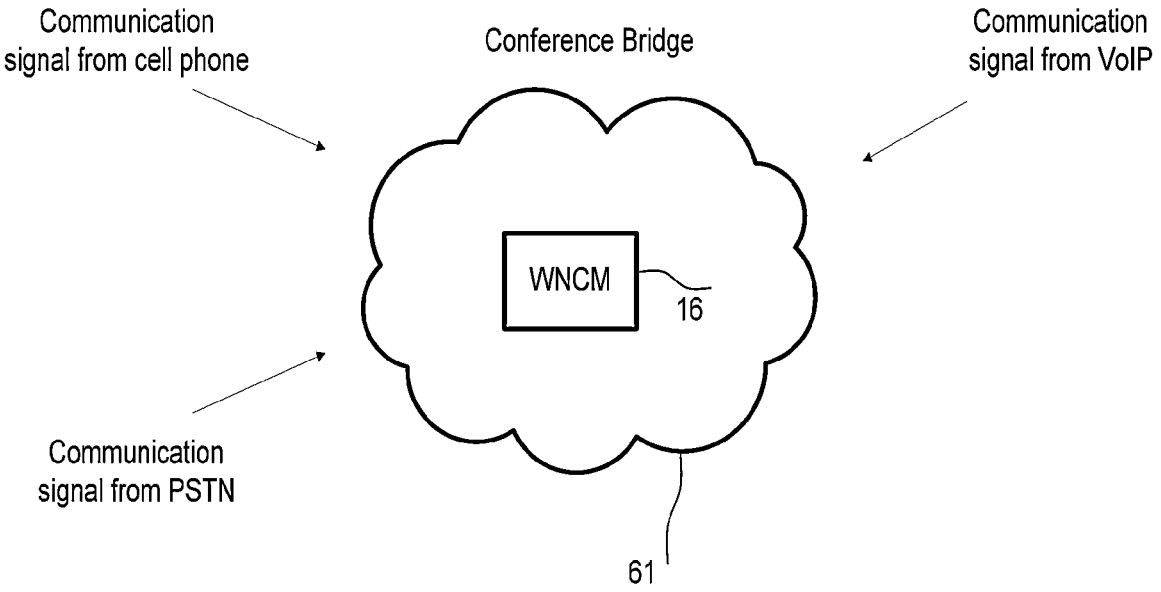
FIG. 6 shows the application of WNCM in a conference bridge environment.

FIG. 6 shows a conference bridge, 61 with WNCM. Block 16 is the WNCM which decides if the communication signal is windy or not.

Figure 7:
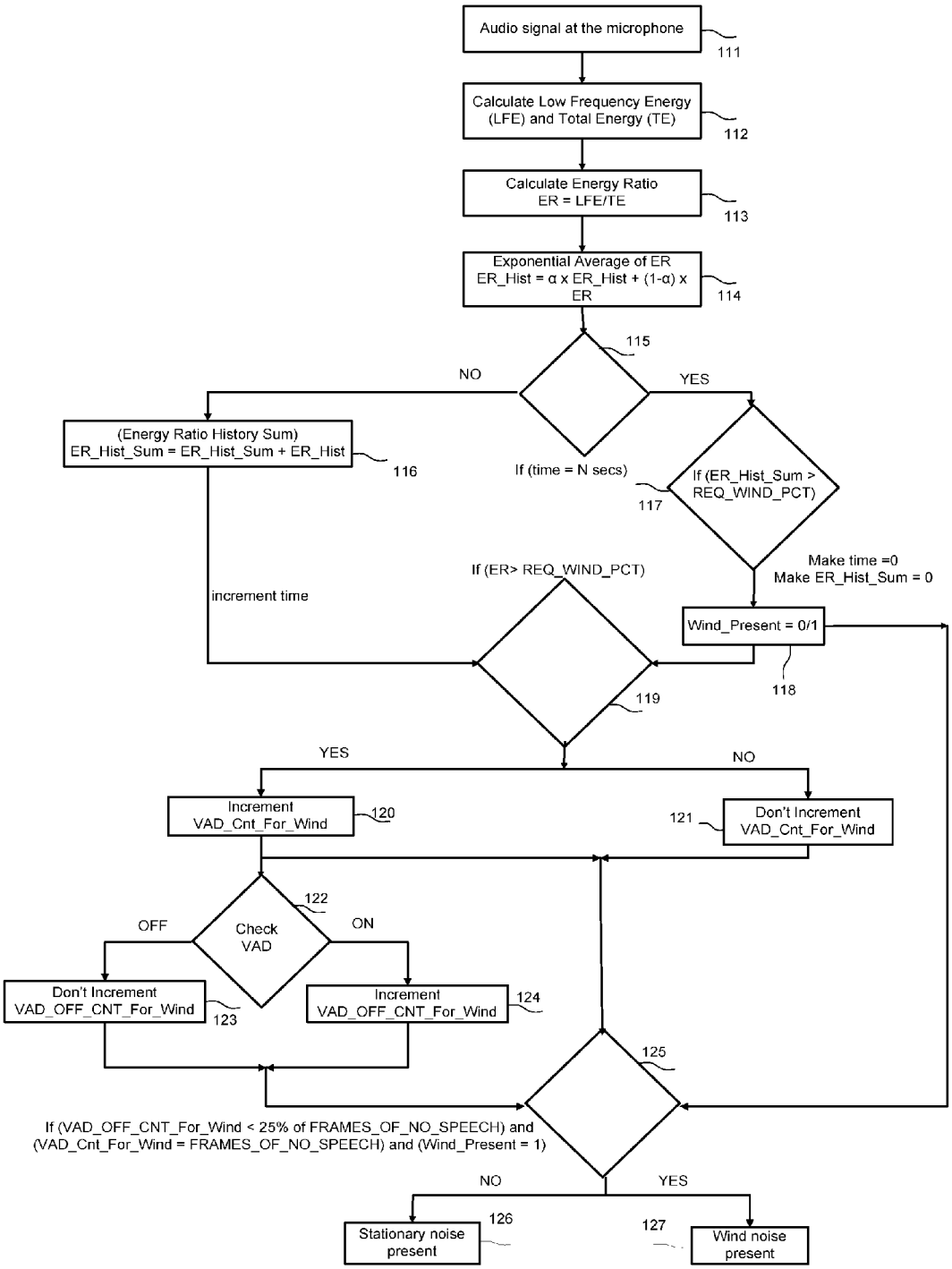
FIG. 7 shows various steps of the current invention involved in the process of wind noise classification.

FIG. 7 shows various steps of the current invention involved in the process of wind noise classification. The audio signal is received at the microphone (block 111). Alternately, the signal at block 111 can be a digital signal from a communication channel/device. Example: cell phone, Bluetooth headset, VoIP gateway, Conference Bridge etc.

The audio signal is processed in blocks of samples called frames. The Low Frequency Energy (LFE) and the Total Energy (TE) of each frame are calculated at block 112. Frequencies below 300 Hz are considered as low frequencies and the energy of those frequencies is calculated and termed as LFE. The ratio between the LFE and the TE is calculated at block 113 and is called Energy Ratio (ER). The Energy Ratio (ER) is given as:

$$ER = \frac{LFE}{TE} \qquad \text{Eq (1)}$$

The Energy Ratio (ER) is exponentially averaged and stored in a variable, ER_Hist. The exponential averaging is done at block 114 and is given in equation 2.

$$\text{ER_Hist} = \alpha \times \text{ER_Hist} + (1-\alpha) \times \text{ER} \qquad \text{Eq (2)}$$

The value of $\alpha$ is chosen to be between 0.50 to 0.99.

At block 115, a variable "time" is compared with N. The units of N is seconds. The value of N is usually chosen to be in the range of 0.1-10 seconds. If time is equal to N seconds, the control goes to block 117. The ER_Hist_Sum is compared with another variable "REQ_WIND_PCT" (chosen to be in the range of 0.05 to 9.5). If ER_Hist_Sum is greater than REQ_WIND_PCT, the variable Wind_Present is 1. If not, Wind_Present variable is 0. The variables "time" and "ER_Hist_Sum" are reset to zero after every N seconds (when time=N).

If at block 115, time is not equal to N seconds, the control goes to block 116, where ER_Hist is summed and stored in a variable called "ER_Hist_Sum". The variable time is incremented and the summation and store is done as:

$$\text{ER_Hist_Sum} = \text{ER_Hist_Sum} + \text{ER_Hist} \qquad \text{Eq (3)}$$

At block 119, the Energy Ratio (ER) is compared with REQ_WIND_PCT. If ER is greater than REQ_WIND_PCT, then a variable "VAD_Cnt_For_Wind" is incremented (block 120). If not, VAD_Cnt_For_Wind is not incremented (block 121).

At block 122, the decision of the Voice Activity Detector (VAD) is checked. If the VAD is ON, another variable "VAD_OFF_CNT_For_Wind" is incremented (block 124). If the VAD (block 122) is OFF, "VAD_OFF_CNT_For_Wind" is not incremented (block 123).

Block 125 checks for three conditions. They are:

a) If "VAD_Cnt_For_Wind" is equal to a variable "FRAMES_OF_NO_SPEECH". FRAMES_OF_NO_SPEECH chosen to be in the range of 100-1000.

b) If "VAD_OFF_CNT_For_Wind" is less than 25% of FRAMES_OF_NO_SPEECH. FRAMES_OF_NO_SPEECH chosen to be in the range of 100-1000 and c) If "Wind_Present" is equal to 1.

If a), b) and c) above are satisfied, wind noise is said to be present (block 127). If not stationary noise is said to be present (block 126).

Figure 8A:
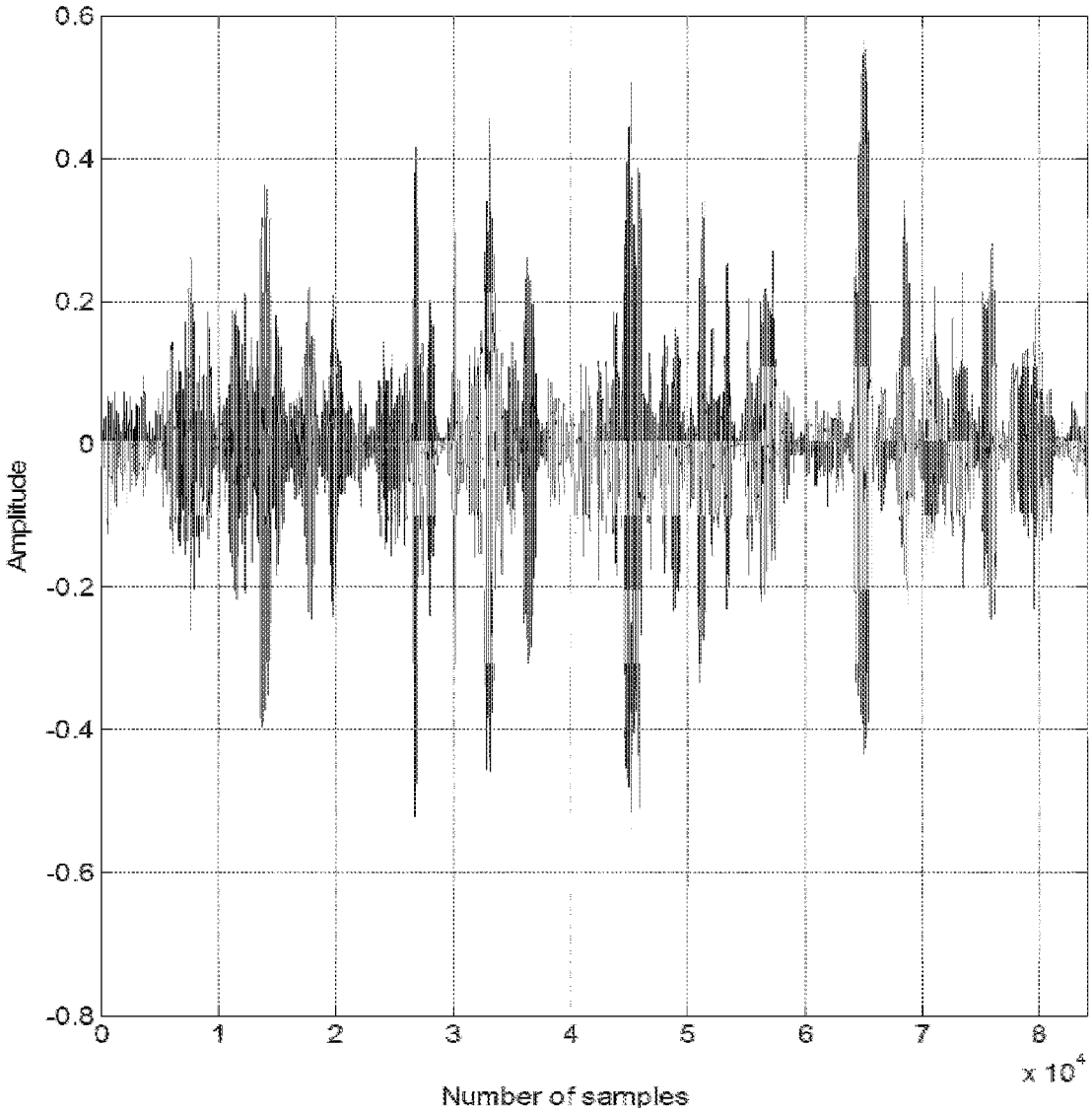
FIG. 8*a* is a diagram of a speech file corrupted with wind noise.

FIG. 8*a* is a diagram of a speech file corrupted with wind noise.

Figure 8B:
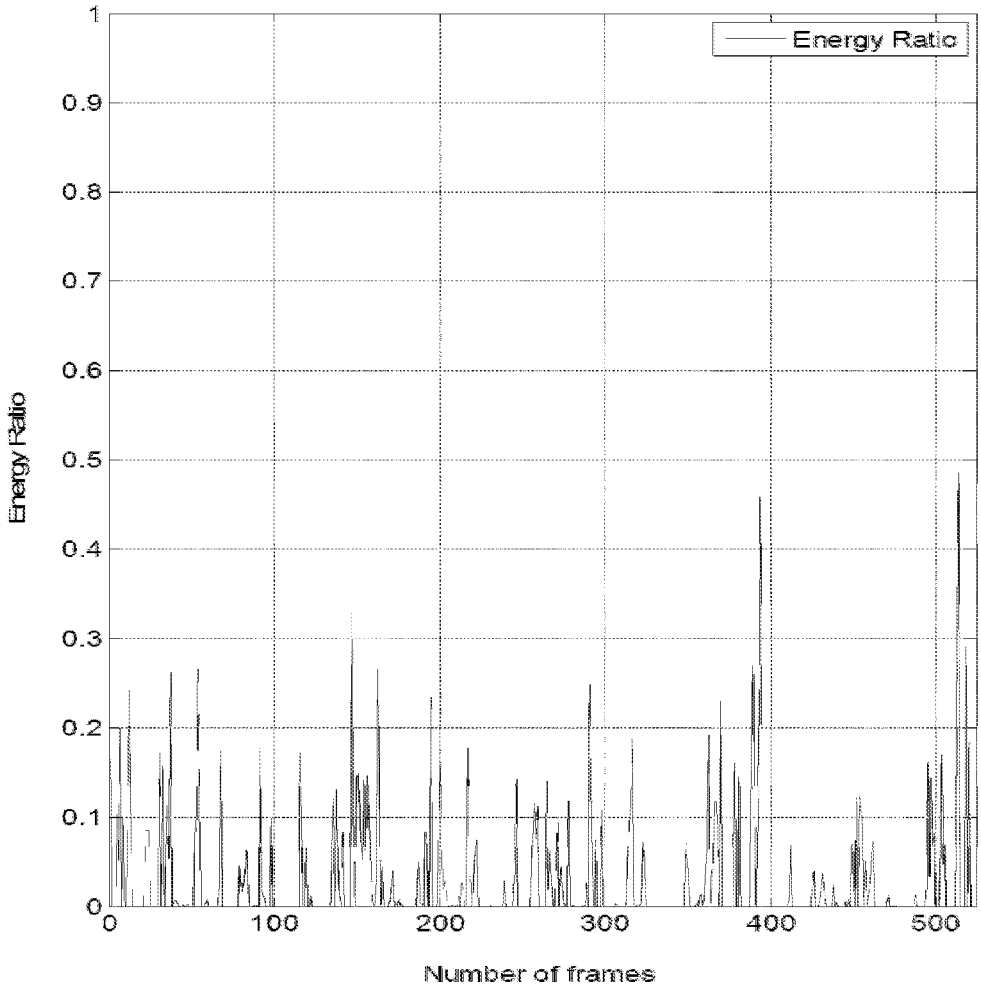
FIG. 8*b* is a diagram of the ratio of Low Frequency Energy (LFE) to the Total Energy (TE) for the signal as described in FIG. 8*a*.

FIG. 8*b* is a diagram of the ratio of Low Frequency Energy (LFE) to the Total Energy (TE) for the signal as described in FIG. 8*a*. The LFE is typically calculated for frequencies less than 300 Hz. When there is speech, the LFE is low. Hence the Energy Ratio (ER) is also low. When there is only wind noise and no speech, the LFE is high. Hence the ER is high.

Figure 9A:
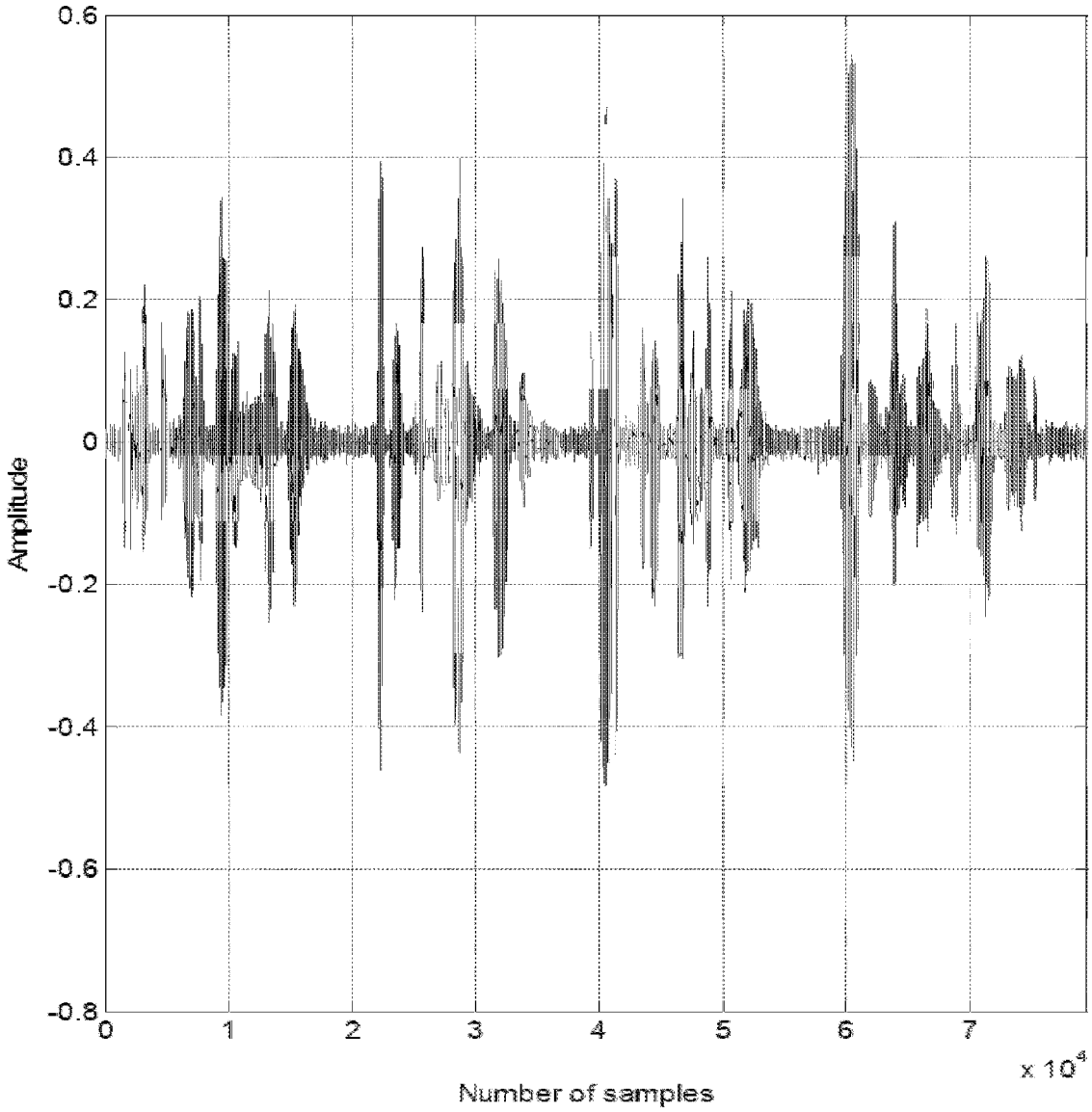
FIG. 9*a* is a diagram of a speech file corrupted with street noise.

FIG. 9*a* is a diagram of a speech file corrupted with street noise.

Figure 9B:
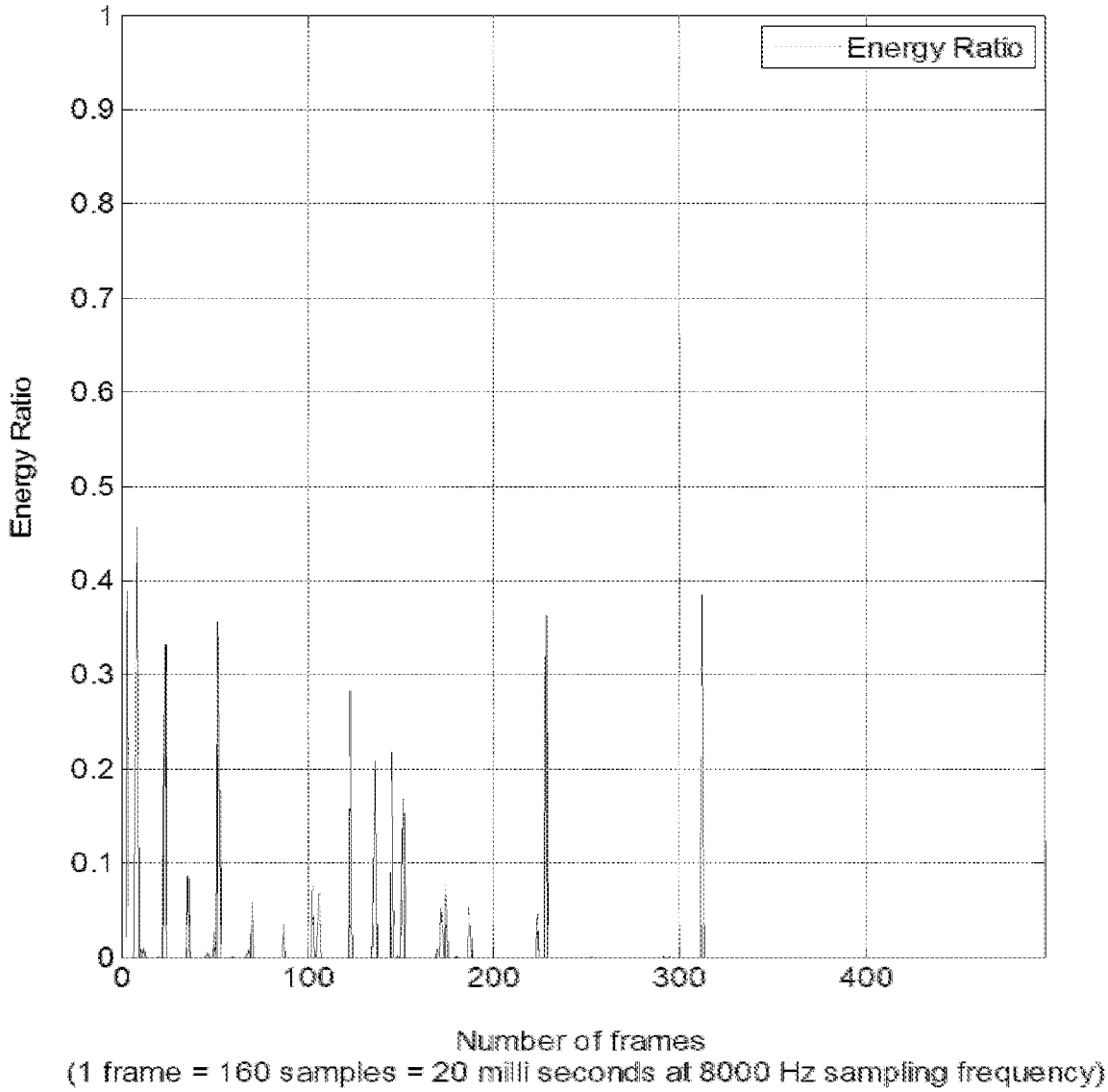
FIG. 9*b* is a diagram of the ratio of LFE to the TE for the signal as described in FIG. 9*a*.

FIG. 9*b* is a diagram of the ratio of LFE to the TE for the signal as described in FIG. 9*a*.

Figure 10A:
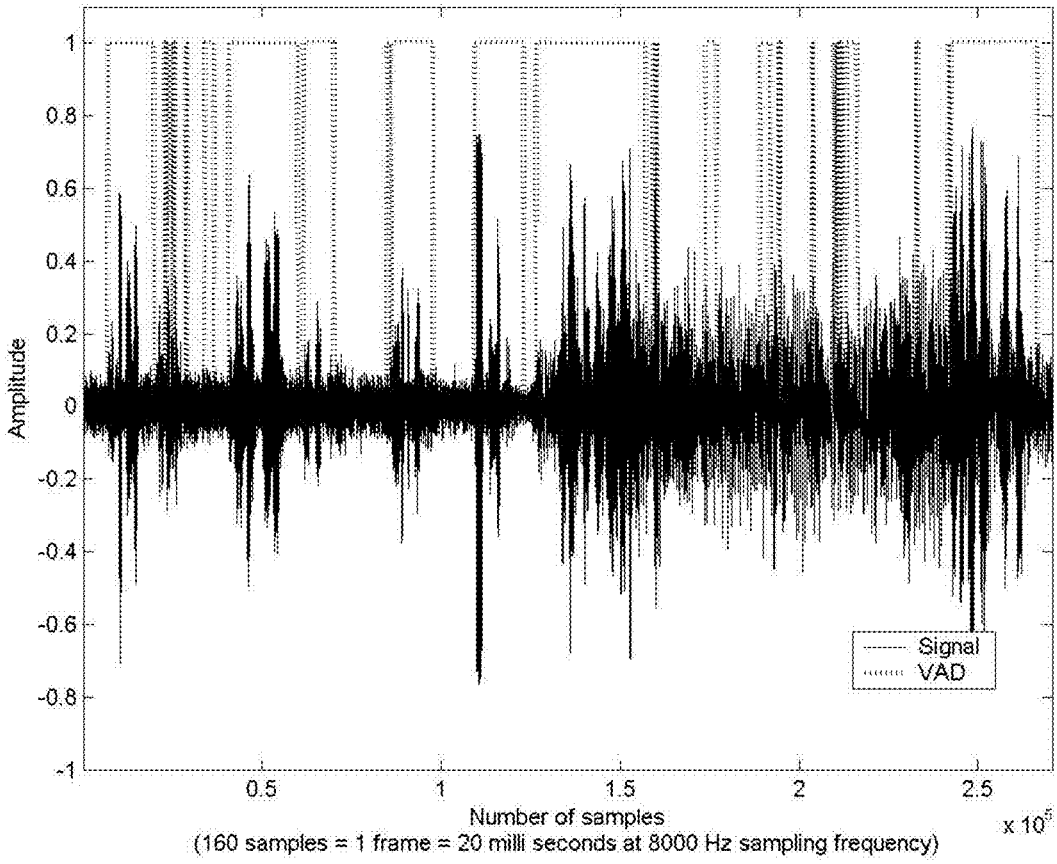
FIG. 10*a* shows the plot of Voice Activity Detector (VAD) for speech with background car noise.

FIG. 10*a* shows the plot of Voice Activity Detector (VAD) for speech with background car noise. The VAD is ON during speech and mostly OFF during noise periods.

Figure 10B:
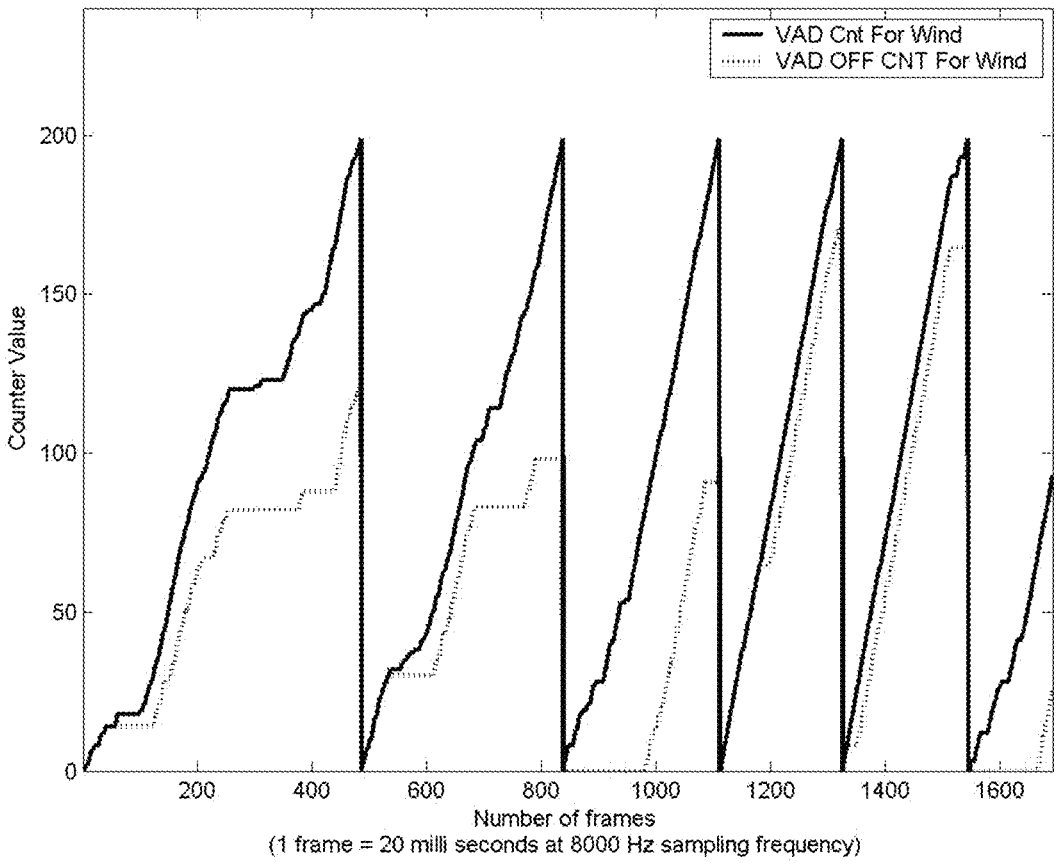
FIG. 10*b* shows the plot of "VAD_Cnt_For_Wind" and "VAD_OFF_CNT_For_Wind" for speech with background car noise.

FIG. 10*b* shows the plot of "VAD_Cnt_For_Wind" and "VAD_OFF_CNT_For_Wind" for the signal described in FIG. 10*a*. The VAD_OFF_CNT_For_Wind is above 25% of FRAMES_OF_NO_SPEECH. The range of FRAMES_OF_NO_SPEECH is chosen as described in [0045].

Figure 11A:
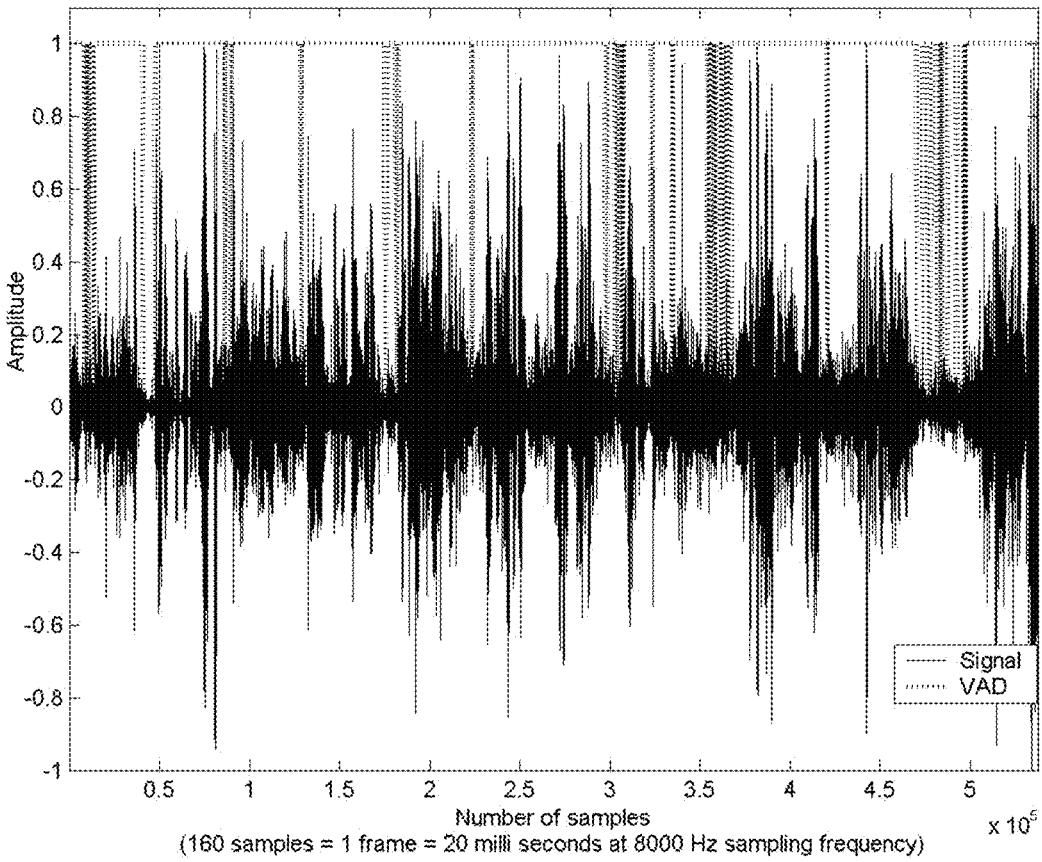
FIG. 11*a* shows the plot of VAD for speech with background wind noise.

FIG. 11*a* shows the plot of VAD for speech with background wind noise. The VAD is ON most of the time.

Figure 11B:
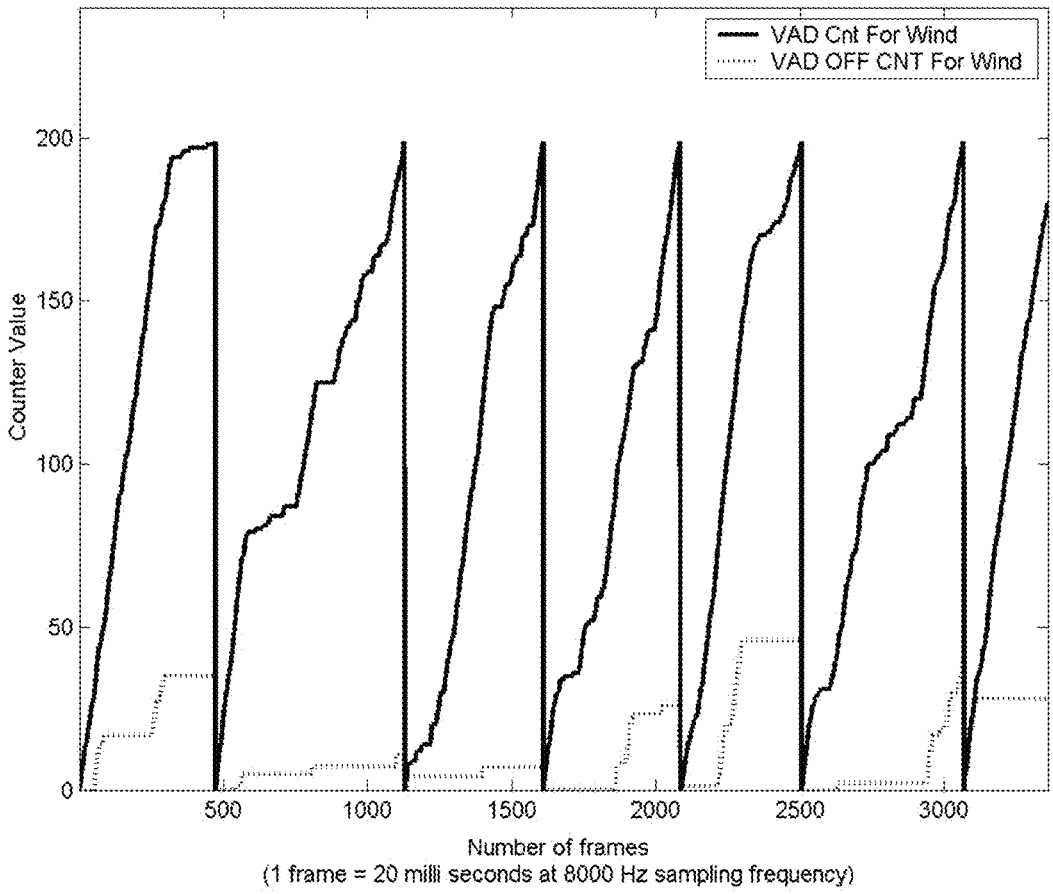
FIG. 11*b* shows the plot of "VAD_Cnt_For_Wind" and "VAD_OFF_CNT_For_Wind" for speech with background wind noise.

FIG. 11*b* shows the plot of "VAD_Cnt_For_Wind" and "VAD_OFF_CNT_For_Wind" for speech with background wind noise. The VAD_OFF_CNT_For_Wind is below 25% of FRAMES_OF_NO_SPEECH. The range of FRAMES_OF_NO_SPEECH is chosen as described in [0045].

As described hereinabove, the invention has the advantages of detecting and classifying wind noise under various conditions. While the invention has been described with reference to a detailed example of the preferred embodiment thereof, it is understood that variations and modifications thereof may be made without departing from the true spirit and scope of the invention. Therefore, it should be understood that the true spirit and the scope of the invention are not limited by the above embodiment, but defined by the appended claims and equivalents thereof.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

Embodiments of the invention include, but are not limited to the following items.

[Item 1] A system for manipulating sound signals for purposes of classification, the system comprising:

a) a communication channel for accepting an audio signal, the communication signal attached to a specialized extraction and processing unit and the audio signal is manipulated on a frame by frame basis or a per frame basis;

b) the specialized extraction and processing unit comprising an external memory unit, an internal memory unit, internal buses and a microprocessor used to:

i. extract and measure Low Frequency Energy (LFE) from an audio signal received from the communication channel, wherein LFE is defined as frequencies less than 300 Hz;

ii. extract and measure total energy (TE) of the audio signal;

iii. divide LFE by TE to derive an Energy Ratio;

iv. obtain an Exponential Average of ER or ER_Hist by modulating the audio signal such that $$ER_Hist=\alpha\times ER_Hist+(1-\alpha)\times ER, \text{ wherein } \alpha \text{ is a value between 0.50 to 0.99;}$$

v. creating a memory location for storage of a variable "ER_Hist_Sum such that ER_Hist is added and stored in memory location ER_Hist_Sum such that:

$$ER_Hist_Sum=ER_Hist_Sum+ER_Hist;$$

vi. creating a memory location for storage of a variable "time" that is incremented for each frame of processed audio signal and wherein the memory location of time and ER_Hist_Sum are reset to zero every N seconds, wherein N is in the range of 0.1 to 10 seconds;

vii. creating a memory location for storage of a variable Wind_Present, having a value of zero or one; wherein if ER_Hist_Sum is greater than Req_Wind_PCT, the variable Wind_Present is 1, if not, the Wind_Present variable is 0;

viii. creating a memory location for storage of a variable Req_Wind_Pct, having a value in the range of 0.05 to 9.5;

ix. when time does not equal N, the ER_Hist_Sum is incremented by ER_Hist; time is incremented, then if ER is greater than Req_Wind_Pct, an increment for VAD_Cnt_For_Wind occurs, a check for VAD then occurs wherein if VAD is on, another variable "VAD_OFF_CNT_FOR_Wind is incremented, and control goes to a three condition check point; if VAD is off, control goes to the three condition check point; at the three condition check point, at the three condition check point, three conditions are checked and all are satisfied, then wind noise is judged as being present and a host device cancels the wind noise, the three conditions are:

If "VAD_Cnt_For_Wind" is equal to a variable "FRAMES_OF_NO_SPEECH". FRAMES_OF_NO_SPEECH chosen to be in the range of 100-1000.

If "VAD_OFF_CNT_For_Wind" is less than 25% of FRAMES_OF_NO_SPEECH. FRAMES_OF_NO_SPEECH chosen to be in the range of 100-1000 and If "Wind_Present" is equal to 1 x. when time does equal N seconds, if ER_Hist_Sum is greater than Req_Wind_Pct, time and ER_Hist_Sum are both set to zero, then:

if the Wind_Present variable is set to 1, control goes to the three condition check point, if the Wind Present variable is set to 0, then if ER is greater than Req_Wind_Pct, an increment for VAD_Cnt_For_Wind occurs, a check for VAD then occurs wherein if VAD is on, and variable "VAD_OFF_CNT_FOR_Wind is incremented, and control goes to a three condition check point; if VAD is off, control goes to the three condition check point.

[ITEM 2] The system of item 1 wherein the communication channel is a microphone.

[ITEM 3] A system comprising:

a) a first processing block, wherein frames comprising audio signal blocks are segregated into low frequency energy (LFE) and total energy (TE), wherein frequencies below 300 Hz are classified as LFE;

b) the LFE is divided by TE and the result is an energy ration or ER;

c) the ER signal is then exponentially averaged and stored in a specialized computer system in a variable ER_Hist, such that HR_Hist=$\alpha\times$ER_Hist+$(1-\alpha)\times$ER wherein the value of $\alpha$ is between 0.50 to 0.99; and d) a second signal processing block wherein a value of time is compared with a value of N, wherein N is a value in units of seconds and is in the range of 0.1 to 10 seconds, if time is equal to N, signal processing continues at a third processing block, if time is not equal to N, signal processing continues to a fourth processing block, wherein ER_Hist is summed and stored in a variable called ER_Hist_Sum, and the variable time is incremented such that ER_Hist_Sum=ER_Hist_Sum+ER_Hist; in the third processing block, the ER_Hist_Sum is compared with another variable "REQ_WIND_PCT" (chosen to be in the range of 0.05 to 9.5), if ER_Hist_Sum is greater than REQ_WIND_PCT, the variable Wind_Present is 1. If not, Wind_Present variable is 0. The variables "time" and "ER_Hist_Sum" are reset to zero after every N seconds (when time=N).

[ITEM 4] The system of item 3 further comprising:

a fifth signal processing block wherein the ER is compared with the REQ_WIND_PCT value. If ER is greater than REQ_WIND_PCT, then a variable "VAD_Cnt_For_Wind" is incremented within a sixth signal processing block, if not a variable VAD_Cnt_For_Wind of a seventh block is not incremented.

[ITEM 5] The system of item 4 further comprising:

an eighth signal processing block wherein the value and decision of the variable voice activity detector (VAD) is checked, such that if the VAD value is on, another variable "VAD_OFF_CNT_For_Wind" is incremented within a ninth signal processing block, if the VAD variable has a value of is off, the variable VAD_OFF_CNT_For_Wind is not incremented.

[ITEM 6] The system of item 5 further comprising:

a tenth signal processing block wherein three conditions are inspected, the three conditions being:

If VAD_Cnt_For_Wind is equal to a variable FRAMES_OF_NO_SPEECH, FRAMES_OF_NO_SPEECH is chosen to be in the range of 100-1000;

If VAD_OFF_CNT_For_Wind is less than 25% of FRAMES_OF_NO_SPEECH. FRAMES_OF_NO_SPEECH chosen to be in the range of 100-1000;

If "Wind_Present" is equal to 1; and if the three conditions are satisfied, wind noise is considered to be present within the signal and the system sends a signal to indicate that wind noise is present; if all three conditions satisfied, stationary noise is considered present in the signal and the system sends a signal to indicate that stationary noise is present.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

What is claimed is:

1. A system for manipulating sound signals for purposes of classification, the system comprising:

a) a communication channel for accepting an audio signal, the communication signal attached to a specialized extraction and processing unit and the audio signal is manipulated on a frame by frame basis or a per frame basis;

b) the specialized extraction and processing unit comprising an external memory unit, an internal memory unit, internal buses and a microprocessor used to:

i. extract and measure Low Frequency Energy (LFE) from an audio signal received from the communication channel, wherein LFE is defined as frequencies less than 300 Hz;

ii. extract and measure total energy (TE) of the audio signal;

iii. divide LFE by TE to derive an Energy Ratio;

iv. obtain an Exponential Average of ER or ER_Hist by modulating the audio signal such that ER_Hist=$\alpha\times$ER_Hist+$(1-\alpha)\times$ER, wherein $\alpha$ is a value between 0.50 to 0.99;

v. creating a memory location for storage of a variable "ER_Hist_Sum such that ER_Hist is added and stored in memory location ER_Hist_Sum such that:

ER_Hist_Sum=ER_Hist_Sum+ER_Hist;

vi. creating a memory location for storage of a variable "time" that is incremented for each frame of processed audio signal and wherein the memory location of time and ER_Hist_Sum are reset to zero every N seconds, wherein N is in the range of 0.1 to 10 seconds;

vii. creating a memory location for storage of a variable Wind_Present, having a value of zero or one; wherein if ER_Hist_Sum is greater than Req_Wind_PCT, the variable Wind_Present is 1, if not, the Wind_Present variable is 0;

viii. creating a memory location for storage of a variable Req_Wind_Pct, having a value in the range of 0.05 to 9.5;

ix. when time does not equal N, the ER_Hist_Sum is incremented by ER_Hist; time is incremented, then if ER is greater than Req_Wind_Pct, an increment for VAD_Cnt_For_Wind occurs, a check for VAD then occurs wherein if VAD is on, another variable "VAD_OFF_CNT_FOR_Wind is incremented, and control goes to a three condition check point;

if VAD is off, control goes to the three condition check point; at the three condition check point, at the three condition check point, three conditions are checked and all are satisfied, then wind noise is judged as being present and a host device cancels the wind noise, the three conditions are:

If "VAD_Cnt_For_Wind" is equal to a variable "FRAMES_OF_NO_SPEECH"

FRAMES_OF_NO_SPEECH chosen to be in the range of 100-1000

If "VAD_OFF_CNT_For_Wind" is less than 25% of FRAMES_OF_NO_SPEECH

FRAMES_OF_NO_SPEECH chosen to be in the range of 100-1000 and

If "Wind_Present" is equal to 1 x. when time does equal N seconds, if ER_Hist_Sum is greater than Req_Wind_Pct, time and ER_Hist_Sum are both set to zero, then:

if the Wind_Present variable is set to 1, control goes to the three condition check point, if the Wind Present variable is set to 0, then if ER is greater than Req_Wind_Pct, an increment for VAD_Cnt_For_Wind occurs, a check for VAD then occurs wherein if VAD is on, and variable "VAD_OFF_CNT_FOR_Wind is incremented, and control goes to a three condition check point; if VAD is off, control goes to the three condition check point.

2. The system of claim 1 wherein the communication channel is a microphone.

* * * * *